US006810943B2

(12) United States Patent
Rahmfeld

(10) Patent No.: US 6,810,943 B2
(45) Date of Patent: Nov. 2, 2004

(54) METHOD AND DEVICE FOR PRODUCING THIN SLABS

(75) Inventor: Werner Rahmfeld, Mühlheim (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/462,024

(22) PCT Filed: Jun. 15, 1998

(86) PCT No.: PCT/DE98/01633

§ 371 (c)(1),
(2), (4) Date: Feb. 3, 2000

(87) PCT Pub. No.: WO99/01244

PCT Pub. Date: Jan. 14, 1999

(65) Prior Publication Data

US 2003/0150589 A1 Aug. 14, 2003

(30) Foreign Application Priority Data

Jun. 30, 1997 (DE) ..... 197 28 957

(51) Int. Cl.[7] ..... B22D 11/00; B22D 11/128

(52) U.S. Cl. ..... 164/459; 164/418; 164/442

(58) Field of Search ..... 164/459, 418, 164/417, 424, 427, 435, 436, 437, 441, 443, 479, 484, 489, 490, 491, 448, 447, 488, 438, 439, 442; 222/590, 591, 594, 606

(56) References Cited

U.S. PATENT DOCUMENTS 4,227,636 A * 10/1980 Rahmfeld et al. ..... 226/189
4,635,702 A * 1/1987 Kolakowski et al. ..... 164/418
4,716,955 A * 1/1988 Fastert ..... 164/475
4,811,779 A * 3/1989 Streubel et al. ..... 164/418
4,881,589 A * 11/1989 Hartmann et al. ..... 164/491
4,928,747 A * 5/1990 Pleschiutschnigg et al. 164/418
4,955,428 A * 9/1990 Schrewe ..... 164/417
5,311,922 A * 5/1994 Streubel ..... 164/418
5,460,220 A * 10/1995 Coassin ..... 164/483
5,467,809 A * 11/1995 Arvedi et al. ..... 164/418
5,520,242 A * 5/1996 Streubel et al. ..... 164/418
5,730,207 A * 3/1998 Pleschiutschnigg ..... 164/459
5,839,503 A * 11/1998 Pleschiutschnigg ..... 164/484
5,916,472 A * 6/1999 Urlau et al. ..... 222/594

FOREIGN PATENT DOCUMENTS

DE 36 27 991 A1 * 2/1988 ..... B22D/11/04
DE 41 31 829 A1 * 4/1992 ..... B22D/11/04
DE 44 03 045 A1 * 9/1995 ..... B22D/11/14

* cited by examiner

*Primary Examiner*—M. Alexandra Elve
*Assistant Examiner*—Kevin P. Kerns
(74) *Attorney, Agent, or Firm*—Cohen, Pontani, Lieberman & Pavane

(57) ABSTRACT

A continuous casting installation for producing thin slabs includes a laterally adjustable mold in which an immersion nozzle protrudes. In the mold there is opposite a larger crowned cross section on the charging side a cross section on the strand outlet side which is small and identically crowned in the central region. The installation further has pairs of supporting and guiding rollers which follow the mold and have a caliber adapted to the emerging crowned strand. The broad-face parts have planar-surface central parts which are arranged parallel to one another along their widths and taper toward one another in the casting direction of the strand. The broad-face parts also have planar side surfaces arranged so that they taper conically toward each other in the direction of the narrow faces. The planar-surface central plate is connected to the planar-surface side surfaces by transitional parts. The transitional parts taper toward each other in the form of a wedge and the wedge tip ends at a distance (a), measured from the upper edge of the mold, with a=0.5 to 0.8×L, where L=the length of the mold. The supporting and guiding rollers have a contour which corresponds to the planar-surface central plate and the planar side plates of the mold broad faces in the region of the mouth of the mold.

12 Claims, 5 Drawing Sheets

Fig. 5a
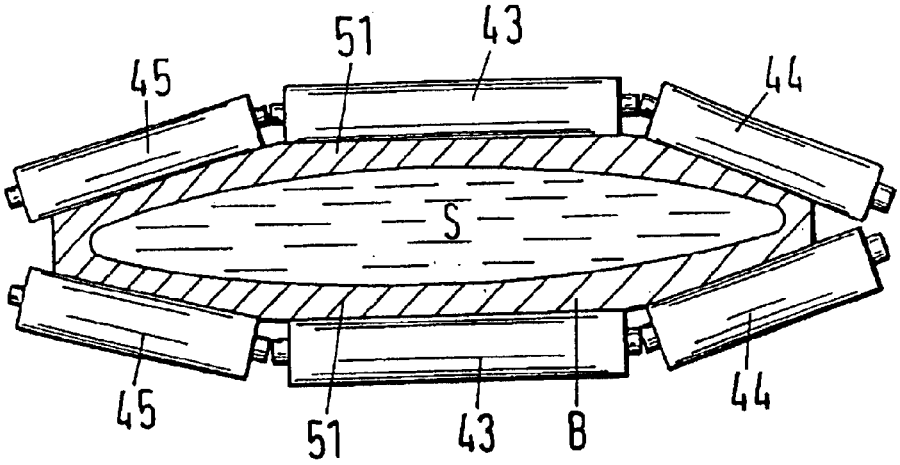
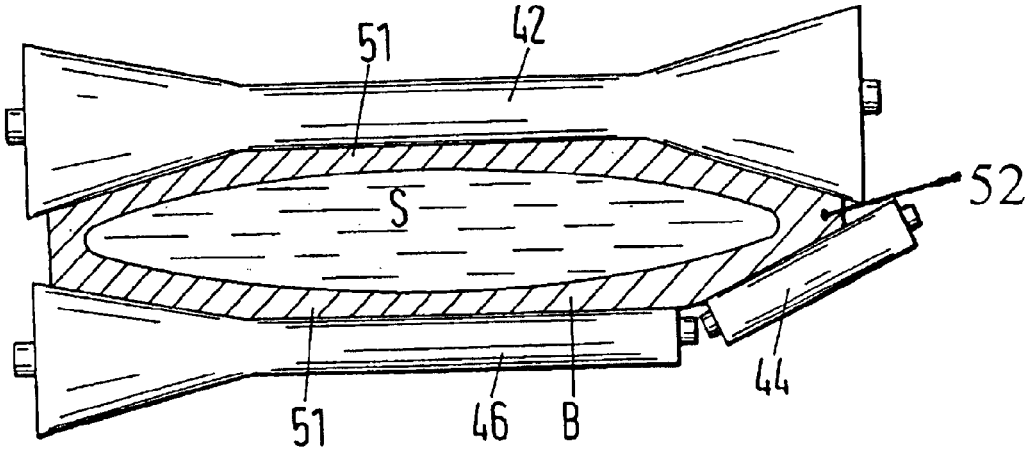
Fig. 5b

METHOD AND DEVICE FOR PRODUCING THIN SLABS

The present application is a national stage application of PCT/DE98/01633, filed on Jun. 15, 1998.

BACKGROUND OF THE INVENTION

1. Field of the Invention

The invention relates to a process for producing thin slabs with a predetermined convexity of their broad faces in a continuous casting installation, in which an immersion nozzle protrudes into a mold followed by a strand guiding means. The invention further relates to a corresponding apparatus for carrying out the process.

2. Discussion of the Prior Art

German reference DE 41 31 829 C2 discloses a liquid-cooled width-adjustable plate mold for the continuous casting of strands of steel in slab format, in particular for a thickness of the slabs below 100 mm. In the plate mold, the form of the broad-face plates at the strand outlet end of the mold corresponds to the strand format to be produced, the broad-face plates being designed as a planar surface in the adjusting region of the narrow-face plates.

This document does not give any suggestion that the strand format to be produced is also to have a convexity after leaving the mold.

German reference DE 36 27 991 discloses an apparatus for continuously casting flat slabs, in particular a steel slab with a thickness below 80 mm. In this apparatus there is, opposite the larger crowned cross section on the charging side, a cross section on the strand outlet side of the mold which is smaller and identically crowned in the central region, and at least one roller of at least one pair of rollers of the supporting and guiding means following the mold has a caliber adapted to the emerging crowned strand.

The mold form known from this document as well as the form of the supporting and guiding means following the mold are designed in such a way that the mold has in the edge region a form adapted to the strand format. In other words there are already in the mold parallel side wall regions, which continue in the surrounding and guiding rollers of the strand guiding framework.

Germman reference 44 03 0 45 discloses a continuous casting installation for guiding strands of which the broad-face plates are made concave and the concavity is constant from the upper edge of the mold to the outlet of the mold and beyond to the last roller of the strand guiding means. The concave form in this case advantageously runs from the beginning of one narrow-face plate to the beginning of the other, opposite narrow-face plate.

The concave form of the broad-face plates known from this document concerns a relatively complicated form, which is influenced substantially by the flexure of the roller and the wear at the time.

The strand shell in the middle mold-width region, and consequently in the region of the pouring gate is disadvantageously subjected to a constant bending deformation as a consequence of the drawing-off movement until it leaves the region of the pouring gate.

In the documents cited, the graduation of the thickness-reduction steps with respect to the width profile of the strand is not clearly definable with respect to the strand thickness deformation with a liquid crater directly beneath the mold, the so-called cast rolling.

SUMMMARY OF THE INVENTION

The object of the invention is to provide by simple constructional means a continuous casting apparatus having a mold and strand guiding rollers which reduce the loading on the strand shell and minimize the risk of longitudinal cracks and break-outs.

According to the invention, the broad faces of the mold are largely made up of planar surface parts and the strand guiding rollers have a contour which is made up substantially of straight lines. Right from the inlet of the mold there is provided in the central region a planar surface, which is maintained in the strand guiding direction and, beyond the mouth of the mold, is taken over completely by the central parts of the guiding rollers.

On both sides of this planar central part there are likewise provided planar surfaces in the direction of the narrow faces. These planar surfaces are exactly maintained both in their form and in their inclination from the inlet of the mold up to the end of the strand guiding framework.

Between the planar central surface of the mold and the planar side surfaces arranged on both sides there are provided transitional pieces. The extent of these transitional pieces ends within the mold, with the result that the lower region corresponds to the strand format. In addition, this form allows simple introduction and delivery of the cold strand when starting up the continuous casting installation.

In an advantageous configuration, the central part is shaped with a planar surface in the charging region. The planar central parts of both broad faces of the slab run conically toward each other in the direction of the strand, until within the mold they are guided in parallel, forming a so-called crown, up to the mouth of the mold.

In a further advantageous configuration, the central parts are planar in their surface and disposed in parallel in the charging region and, outside the shadow region of the immersion nozzle in the strand guiding direction, are connected by a connecting part to the central part having the "crown" in the region of the mouth of the mold. The central parts have in this case a form of which the contour lines are parallel to one another and of which the longitudinal extent is designed in the form of an S in the strand conveying direction. The mouth of this S-form respectively goes over tangentially into the neighboring surfaces.

The slab produced in a mold according to the invention has broad faces which are made up of three planar surfaces, the side surfaces being conically shaped and the central surface being shaped with an elevation in comparison with the edge region. This form of slab makes better centering of the slab possible, especially with the strand drawing-off speeds customary nowadays. Uncontrolled movement of the strand in the mold and so-called snaking in the strand guiding framework are avoided as a result.

The outer form of the strand shell of the slab thus produced remains absolutely constant, at least as far as the lowest point of the liquid crater. The only change which the slab undergoes takes place in the direction of its thickness, only the narrow faces being deformed.

The middle mold-width region, to be precise the region designed as a trough, remains unchanged in its planar form until solidifying right through and ensures the most favorable lubricating conditions in the mold. The mold form according to the invention has the effect that the casting powder wets the surface of the strand with an amount which can be reliably predetermined in the region of the greatest susceptibility to longitudinal cracks. Thus, thanks to its planar form, the strand shell is not subjected to any bending stress favoring the occurrence of cracks close to the surface in this middle mold-width region.

The solidifying conditions of the strand shell are especially influenced in the region of the transitional parts and the connecting part by separate channelling of cooling media.

The following strand guiding framework has supporting and guiding rollers, which ensure reliable transporting of the slab still having a crater. According to the invention, various forms of roller are proposed, to be precise complete rollers or else split rollers.

In the case of the split rollers, use is made of simple cylindrical rollers which are adapted to one another according to the shaping of the central or side surfaces of the slab form predetermined by the mold.

Furthermore, it is proposed to divide the rollers in a ratio of 2/3 to 1/3, and to carry out this division alternately. In this case, the 2/3 roller has a contour corresponding to the assignment of the central part to the side part.

Depending on the slab width, in the case of smaller dimensions in particular, use may be made of complete rollers, which have as their contour the negative form of the lower part of the mold.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OT HE DRAWINGS

An example of the invention is presented in the attached drawing, in which.

FIGS. 5*a* 5*b* shows a section through the strand guiding framework.

DETAILED DESCRIPTION OF THE PREFERRED EMBODIMENTS

Figure 1:
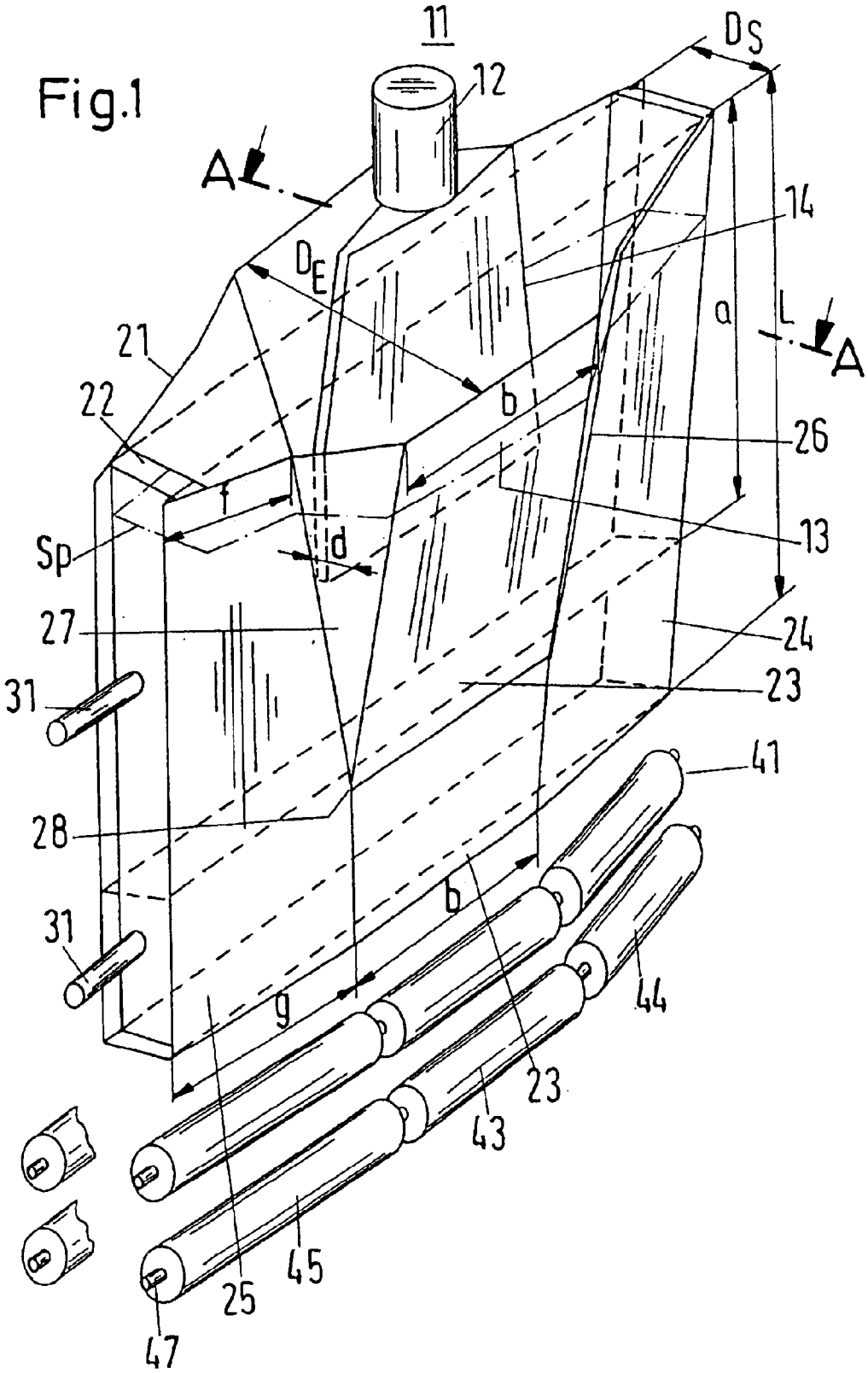
FIG. 1 shows a continuous casting mold with a constant central part.
Figure 2:
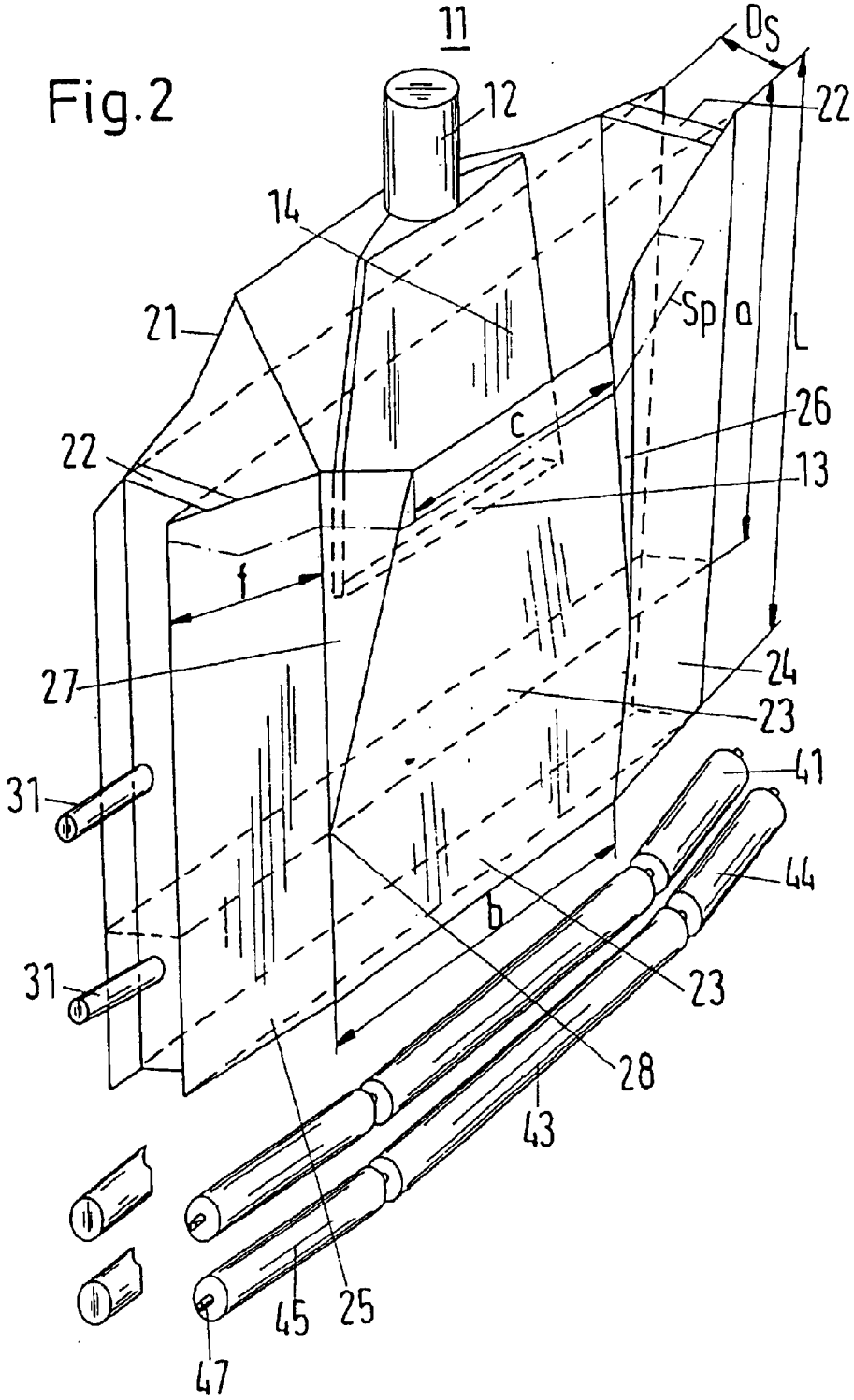
FIG. 2 shows a continuous casting mold with constant side parts.

FIGS. 1 and 2 perspectively show a mold with a following strand guiding framework.

The mold has in this case broad faces 21, between which narrow faces 22 are clamped. The broad faces have a central surface 23, which is shaped with a planar surface and is disposed from the inlet up to the mouth of the mold. The greatest distance between the broad faces is designated $D_E$ in FIG. 1.

In the charging region up to a length a, calculated from the inlet of the mold, the central parts are arranged parallel with one other with respect to their contour line and, overall, run conically toward one another in the strand conveying direction. In this region, the central parts 23 are connected to side parts 24 and 25 via transitional parts 26 and 27.

The transitional parts 26 and 27 are shaped in the form of wedges, the wedge tip 28 still within the mold being spaced apart from the mold inlet by the distance a.

At the narrow faces 22 there are provided adjusting elements 31, by which the narrow faces 22 clamped between the broad faces 21 are adjustable for changing the slab format.

Provided beneath the mold are supporting and guiding rollers 41. In the present example, split rollers 43–45, having a cylindrical form, are represented which are mounted on bearings 17.

In FIG. 1, the width of the central part 23 is denoted by b. In the present figure, the width b remains constant, beginning in the charging region of the mold and extending up to the mouth of the mold.

In the charging region, the side parts have a width f which, following the conical transitional part 26 or 27, widens to the width g and maintains this width constantly up to the mouth of the mold.

In FIG. 2, in the charging region, the central part has a width c which, following the wedge-shaped transitional parts 26, 27, widens to the width b in the strand casting direction up to the length a of the mold and, from there, remains constant up to the mouth of the mold.

In the case of this configuration, the width f of the side parts 24 and 25 remains constant over the entire length L of the mold.

An immersion nozzle 11, which has a tubular part 12 and a rectangular part 14, protrudes into the mold. The mouth 13 of the said immersion nozzle reaches under the level of the melt Sp (dashed line). The immersion nozzle has a thickness d.

Figure 3:
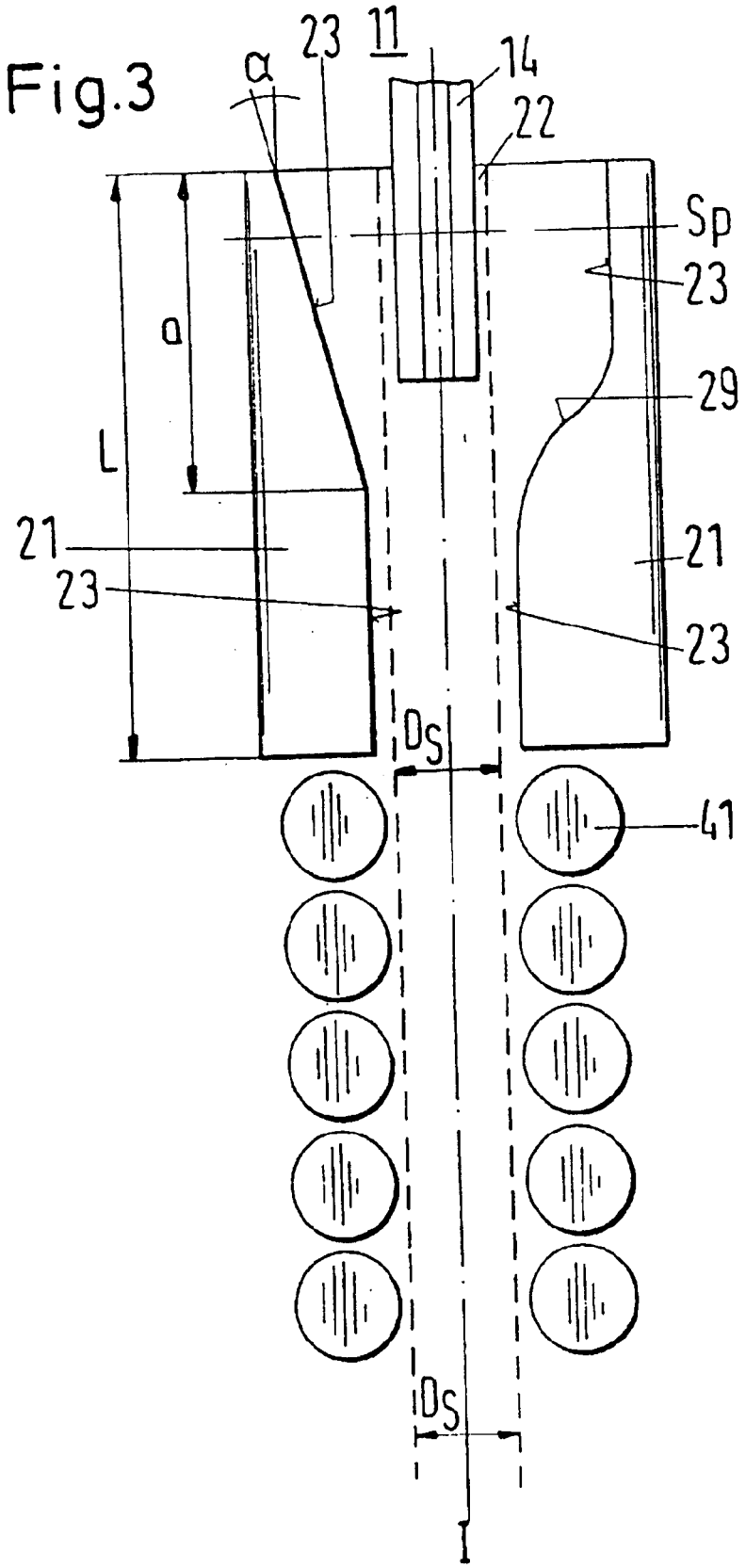
FIG. 3 shows a section through the continuous casting apparatus.

FIG. 3 shows a section AA through the broad faces 21 of the mold.

Represented in the left-hand part of FIG. 3 is the planar-surface central part 23, which at the distance a goes over into a straight region, disposed parallel to the opposite central part.

In the right-hand part of FIG. 3, a first portion of the central part 23 has a planar surface and is disposed parallel to the center axis I. This parallel part is adjoined with a tangential transition by a connecting part 29, which has in section an S-shaped form and in turn goes over into the parallel part of the central part 23 in the direction of the mouth.

In the inlet region, the spade-shaped part 14 of the immersion nozzle 11 protrudes into the mold, reaching under the level of the melt Sp.

Represented beneath the mold are the supporting and guiding rollers 41.

The dashed line represents the distance $D_S$ between the side parts 24 and 25, and consequently also the narrow face of the slab.

Figure 4:
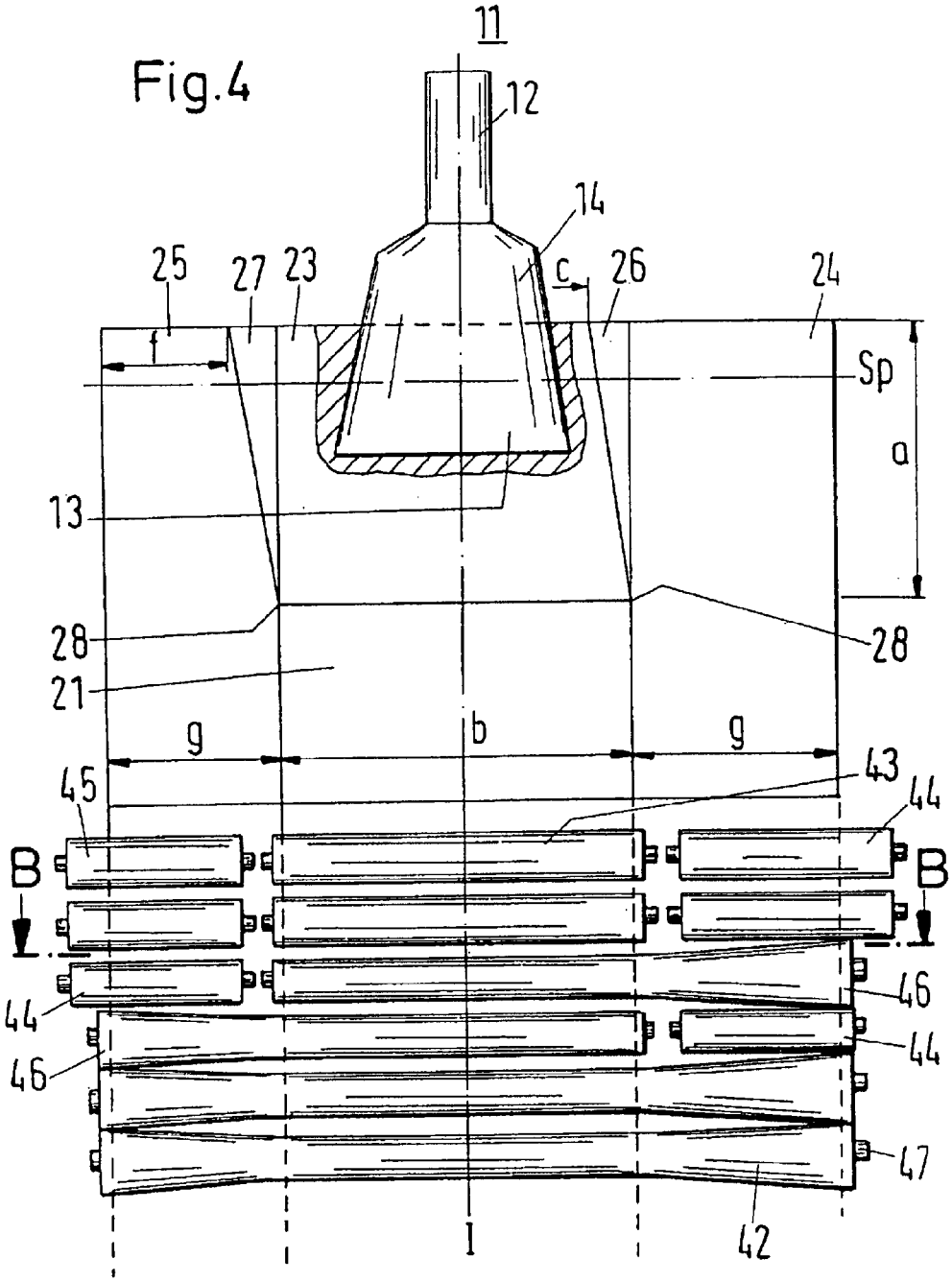
FIG. 4 shows a plan view of the continuous casting apparatus.

Represented in FIG. 4 is a plan view of a mold broad face, together with the immersion nozzle 11 with its tubular part 12 and its rectangular part 14 and also the mouth 13, which reaches under the level of the melt Sp.

Represented in the right-hand part of FIG. 4 is the side part 24, which has a constant width g.

Represented in the left-hand part of FIG. 4 is the side part 25, which has in the inlet region of the mold a width f which, conically following the conical transitional part, has from the wedge tip 28 a width g.

The central part 23 has with regard to the left-hand side of the figure a constant width b.

With regard to the right-hand side, the central part 23 has a width c which widens in a way corresponding to the conical transitional part 26 and has from the wedge tip 28 the constant width b.

Represented beneath the mold are various rollers 43, 44.

Directly following the mold there are represented in FIG. 4 a total of three rollers 43, 44, which respectively have a cylindrical form and are inclined toward one another in a way corresponding to the inclination of the sides and of the central surface of the slab produced.

The rollers, represented as the $3^{rd}$ and $4^{th}$ set from the top, comprise a 2/3 roller 46 and a cylindrical roller 44. The roller 46 has a cylindrical portion and a conical part adapted to the inclination of the side surfaces.

Represented as the $5^{th}$ and $6^{th}$ sets are rollers of which the complete contour corresponds to the slab produced in the preceding mold, both in the central region and in the side regions.

FIGS. 5*a* and 5*b* show a section through the guiding framework and the slab still having a crater in this region. Represented in FIG. 5*a* is the situation with the opposite pairs of rollers in the central region 43 and in the side regions 44, 45. These rollers support the broad faces 51 of the shell box made up of the broad faces 51 and the narrow faces 52 of the strand shell B. The shell box thereby envelops the melt S, which forms in this region the crater within the slab.

Represented in FIG. 5*b* is the situation with a complete roller 42, which has a cylindrical central part and conically enlarging side regions.

Also represented is a 2/3 roller 46, which supports the greater part of the slab broad face 51 and is adjoined in the right-hand part of the illustration by a cylindrical roller 44, which supports the narrow face region.

FIG. 5*b* clearly shows the slab having a "crown", which slab can be guided exactly through the strand guiding framework by the forms of rollers proposed here.

What is claimed is:

1. A process for producing a thin slab having broad faces with a predetermined convexity in a continuous casting installation, in which a spade-shaped immersion nozzle protrudes into a mold composed of broad and narrow faces followed by a strand guiding means for guiding the slab which comprises a strand shell surrounding a liquid sump, said process comprising the steps of:

a) forming broad faces of the strand shell to have planar surfaces in a region of the spade-shaped immersion nozzle using central parts of the mold broad face, wherein widths of the planar surfaces extend in parallel directions and lengths of the planar surfaces taper conically toward a slab guiding direction;

b) shaping said broad faces of the strand shell with planar side surfaces of the mold broad face that taper conically to the narrow faces, in which the side surfaces of the mold broad face are at an angle to the central parts;

c) in a strand casting direction, feeding parts of the slab broad faces shaped with planar surfaces conically to each other up to 40 to 60% of the mold length to such a degree that lateral edges of the faces adapt themselves to ends of the planar side surfaces of the slab, wherein the mold broad faces tapering conically with respect to narrow faces of the slab, includes wedge-shaped connecting pieces joined with the central parts and side parts of the broad faces, and wherein the central part extends past sides of the spade-shaped immersion nozzle; and d) subsequently, in a mouth region of the mold at a slab exit end of the mold and after leaving the mold, maintaining convexity formed by in each case three planar surface parts of the broad faces of the strand shell constant in its form as far as a lowest point of a liquid crater of the slab.

2. A process as defined in claim 1, including reducing slab thickness in a region of a strand guiding framework by only deforming the narrow faces of the slab.

3. A process as defined in claim 1, wherein the wedge-shaped connecting pieces between the central part of the slab, located in the region of the spade-shaped immersion nozzle, and the slab broad-face parts tapering conically toward the narrow faces are given a form which encloses an angle $\alpha<5°$ in a longitudinal direction of the central parts of the slab and represents a crowned surface which, having a central point of inflection, adjoins tangentially at its edges to two neighboring surfaces.

4. A process defined in claim 1, wherein a cross-section of the mold throughout a region of the mold below the wedge-shaped transitional parts corresponds to the cross-section on the strand outlet side of the mold.

5. A continuous casting installation for producing a thin slab, comprising:

a laterally adjustable mold, the mold having broad side parts, narrow side parts, a large crowned cross-section on a charging side and a cross-section, opposite the crowned cross-section, on a strand outlet side which is smaller than the crowned cross-section an identically crowned in a central region;

a spade-shaped immersion nozzle that protrudes into the mold, the immersion nozzle having a mouth with a maximum thickness (d) corresponding to d=0.3 to $0.5\times D_E$ where $D_E$ is a distance between the mold broad side parts in a charging region, the broad side parts of the mold having, at least in a region of the immersion nozzle, central part comprising planar surfaces which have widths extending in parallel directions and taper conically in a slab direction, and planar side surfaces, the planar side surfaces being arranged so that they taper conically toward each other to the narrow side parts, the central part being connected to the planar side surfaces by wedge-shaped transitional parts, the wedged-shaped transitional parts tapering toward each other and having a tip that ends at a distance (a), measured from an upper edge of the mold, with a=0.5 to $0.8\times L$, where L is the length of the mold; and a plurality of supporting and guiding rollers which follow the mold and have a caliber for receiving an emerging crowned strand, the supporting and guiding rollers having a contour which corresponds to the central part and the side parts of the mold broad side parts in a region of a mouth at a strand exit end of the mold.

6. A continuous casting installation as defined in claim 5, wherein the central parts are planar surfaces which move conically toward each other in a strand conveying direction at an angle $\alpha$=5 to 10° with $\alpha$=0.5to $0.8\times L$.

7. A continuous casting installation as defined in claim 4, wherein the central parts are shaped with planar surfaces in the region of the spade-shaped immersion nozzle up to a=0.5 to $0.8\times L$ and are arranged so as to be disposed parallel to one another, the mold further having connecting parts with contour lines, the connecting parts being parallel with respect to their contour lines and having, in a strand conveying direction, an S-shaped form, the wedge-shaped transitional parts following the S-shape form of the connecting part in their longitudinal extent up to the tip.

8. A continuous casting installation as defined in claim 5, wherein the wedge-shaped transitional parts are shaped as a crowned surface the crowned surface tangentially adjoining at one end, a respective slab side part and at the other end, the slab central part and having a central point of inflection.

9. A continuous casting installation as defined in claim 5, wherein the supporting and guiding rollers comprise split rollers, the split rollers having bearings provided in a region of the central part.

10. A continuous casting installation as defined in claim 5, and further comprising rollers which are designed cylindrically in a central region and conically in side regions, with a diameter which enlarges outwardly so as to correspond to shaping of the slab.

11. A continuous casting installation as defined in claim 5, and further comprising means for cooling the transitional parts.

12. A continuous casting installation as defined in claim 5, wherein a cross-section of the mold throughout a region of the mold below the wedge-shaped transitional parts corresponds to the cross-section on the strand outlet side of the mold.

* * * * *